US006075323A

United States Patent [19]

Smith et al.

[11] Patent Number: 6,075,323

[45] Date of Patent: Jun. 13, 2000

[54] METHOD FOR REDUCING CHARGE ACCUMULATION IN A FIELD EMISSION DISPLAY

[75] Inventors: Robert T. Smith, Tempe; Johann Trujillo, Mesa; Chenggang Xie, Phoenix, all of Ariz.

[73] Assignee: Motorola, Inc., Schaumburg, Ill.

[21] Appl. No.: 09/009,233

[22] Filed: Jan. 20, 1998

[51] Int. Cl.[7] ..... H05B 37/02

[52] U.S. Cl. ..... 315/169.1

[58] Field of Search ..... 315/169.1; 313/309

[56] References Cited

U.S. PATENT DOCUMENTS 5,438,240 8/1995 Cathey et al. ..... 315/169.1

*Primary Examiner*—Michael B Shingleton
*Attorney, Agent, or Firm*—Kate A. Tobin; S. Kevin Pickens

[57] ABSTRACT

A method for reducing charge accumulation in a field emission display (100) includes the steps of causing a plurality of electron emitters (114) to emit electrons (132) to reduce the potential at an anode (124) of the field emission display (100). Upon the reduction of the potential at the anode (124), the electrons (132) neutralize a positively electrostatically charged surface (129) of a spacer (130). The anode potential is dropped by providing a resistor (127) in series with a voltage source (126) connected to the anode (124). The anode potential is reduced by causing the electron emitters (114) to emit simultaneously to provide a pull-down current (128) at the anode (124). The voltage at the anode (124) is reduced to a value that causes a sufficient flux of electrons (132) to be attracted to the charged surfaces (129) for neutralizing them.

18 Claims, 1 Drawing Sheet

METHOD FOR REDUCING CHARGE ACCUMULATION IN A FIELD EMISSION DISPLAY

FIELD OF THE INVENTION

The present invention relates, in general, to field emission devices, and, more particularly, to methods for reducing charge accumulation in field emission displays.

BACKGROUND OF THE INVENTION

Field emission displays are well known in the art. They include an anode plate and a cathode plate that define a thin envelope. Typically, the anode plate and cathode plate are thin enough to necessitate some form of a spacer structure to prevent implosion of the device due to the pressure differential between the internal vacuum and external atmospheric pressure. The spacers are disposed within the active area of the device, which includes the electron emitters and phosphors.

The potential difference between the anode plate and the cathode plate is typically within a range of 300–10,000 volts. To withstand the potential difference between the anode plate and the cathode plate, the spacers typically include a dielectric material. Thus, the spacers have dielectric surfaces that are exposed to the evacuated interior of the device.

During the operation of the field emission display, electrons are emitted from electron emitters, such as Spindt tips, at the cathode plate. These electrons traverse the evacuated region and are impinge upon the phosphors. Some of these electrons can strike the dielectric surfaces of the spacers. In this manner, the dielectric surfaces of the spacers become charged. Typically, the dielectric spacers become positively charged because the secondary electron yield of the spacer material is initially greater than one.

Numerous problems arise due to the charging of dielectric surfaces within a field emission display. For example, control over the trajectory of electrons adjacent to the spacers is lost. Also, the risk of electrical arcing events increases dramatically.

Accordingly, there exists a need for method for reducing charge accumulation in a field emission display.

BRIEF DESCRIPTION OF THE DRAWINGS

Referring to the drawings.

Figure 1:
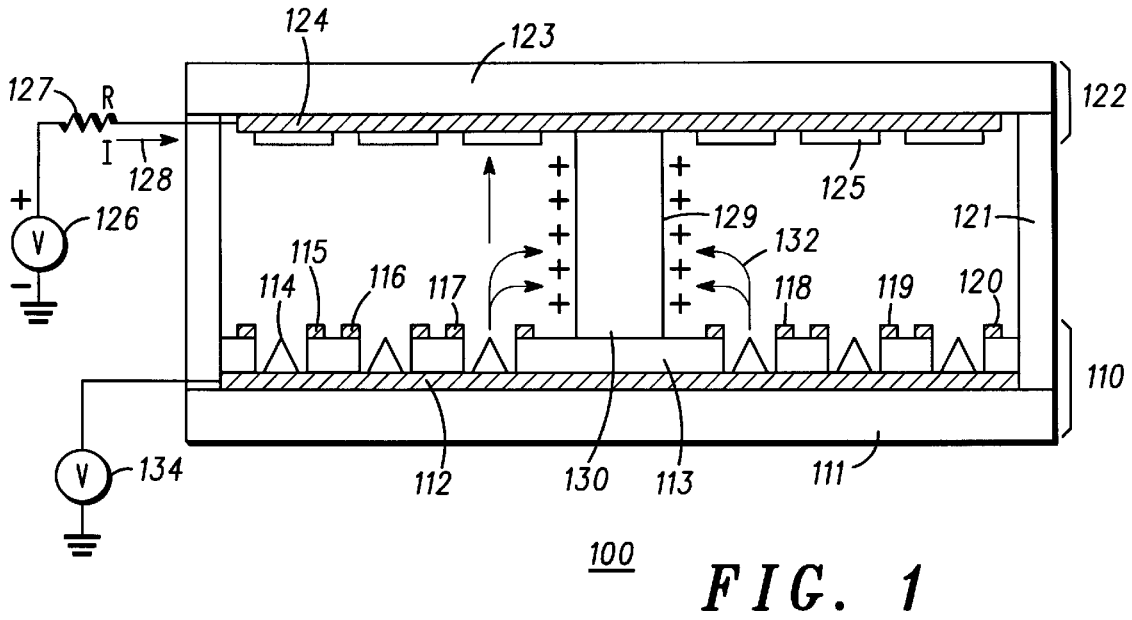
FIG. 1 is a cross-sectional view of a field emission display in accordance with an embodiment of the invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DESCRIPTION OF THE PREFERRED EMBODIMENTS

The invention is for a method for reducing charge accumulation in a field emission display. The method of the invention includes the steps of causing electron emitters to emit electrons and adjusting the controllable potentials within the display so that the potentials at positively charged surfaces are capable of attracting emitted electrons to the charged surfaces. In this manner, the positively charged surfaces are neutralized. In a preferred embodiment, the field emission display has spacers that become positively charged during operation. To neutralize this charge, the high positive potential at the anode plate is reduced at the end of each frame time. The anode potential is caused to drop by first providing a resistor in series with the anode voltage source. The anode potential is pulled down by causing all of the electron emitters to emit simultaneously to provide a pull-down current at the anode. The resistance of the resistor is selected to cause a useful anode voltage drop for the given value of the pull-down current. The voltage drop is sufficient to cause some of the emitted electrons to be attracted toward positively charged surfaces and thus neutralize the surfaces.

FIG. 1 is a cross-sectional view of a field emission display 100 in accordance with an embodiment of the invention. Field emission display 100 includes a cathode plate 110 and an anode plate 122. Cathode plate 110 includes a plurality of electron emitters 114, which are formed upon a substrate 111. Substrate 111 is made from a dielectric material, such as glass, silicon, and the like. Cathode plate 110 further includes a plurality of rows and a plurality of columns for selectively addressing electron emitters 114. The rows and columns are made from a convenient conductive material.

To facilitate understanding, FIG. 1 depicts only a few rows (rows 115, 116, 117, 118, 119, 120) and one column (column 112). However, it is desired to be understood that any number of rows and columns can be employed. An exemplary number of rows for field emission display 100 is 240, and an exemplary number of columns is 720.

Column 112 is disposed upon substrate 111, and a dielectric layer 113 is formed upon column 112. Dielectric layer 113 defines wells in which are disposed electron emitters 114. Rows 115, 116, 117, 118, 119, 120 are formed on dielectric layer 113. Methods for fabricating cathode plates for matrix-addressable field emission displays are known to one of ordinary skill in the art.

Anode plate 122 includes a transparent substrate 123 made from, for example, a glass. An anode 124 is disposed on substrate 123. Anode 124 is a made from a transparent conductive material, such as indium tin oxide. In the preferred embodiment, anode 124 is a continuous layer that opposes the entire emissive area of cathode plate 110. That is, anode 124 opposes the entirety of electron emitters 114. An ode plate 122 further include s a plurality of phosphors 125, which are made from a cathodoluminescent material and are disposed upon substrate 123. Methods for fabricating anode plates for matrix-addressable field emission displays are also known to one of ordinary skill in the art.

Field emission display 100 further includes a frame 121 and a plurality of spacers 130, all of which are disposed between anode plate 122 and cathode plate 110. Frame 121 and spacers 130 are useful for maintaining a separation distance between cathode plate 110 and anode plate 122. In the embodiment of FIG. 1, frame 121 is a rectangular structure that circumscribes the active areas of cathode plate 110 and anode plate 122. For ease of illustration, only one of spacers 130 is depicted in FIG. 1. The actual number of spacers 130 depends on the structural requirements of the device.

Spacers 130 are made from a dielectric material. Spacers 130 can be thin plates/ribs of a dielectric material.

Alternatively, each of spacers 130 can include multiple elements, some of which are dielectric. For example, each of spacers 130 can include layers of different materials, at least one of which is a dielectric. The dielectric material defines a surface, which becomes a positively electrostatically charged surface 129 during the operation of field emission display 100. Other surfaces within field emission display 100 may also become positively electrostatically charged during the operation of the device. The method of the invention is also useful for reducing the charge on these surfaces.

A voltage source 134 is connected to column 112 for applying the appropriate voltage to column 112 as defined by video data. A voltage source 126 is connected to anode 124. In the preferred embodiment, voltage source 126 is a direct current (D.C.) voltage source. In the preferred embodiment, a resistor 127 is connected in series between voltage source 126 and anode 124. A row driver (not shown) is connected to rows 115, 116, 117, 118, 119, 120. The row driver applies the appropriate potentials to rows 115, 116, 117, 118, 119, 120 for creating the display image and for reducing charge accumulation in field emission display 100, in accordance with the invention.

Figure 2:
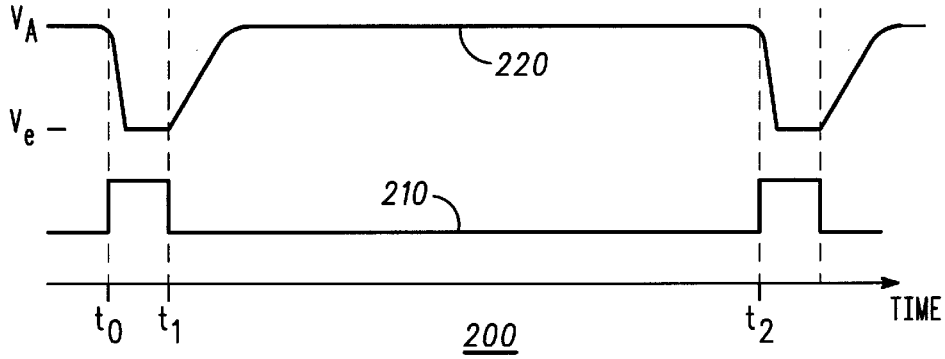
FIG. 2 is a timing diagram for a method of reducing charge accumulation in a field emission display in accordance with the invention.

The operation of field emission display 100 will now be described with reference to FIGS. 1 and 2. FIG. 2 is a timing diagram 200 for a method of reducing charge accumulation in field emission display 100 in accordance with the invention. Timing diagram 200 includes a timing graph 210 for the row driver and an anode voltage response graph 220. Anode voltage response graph 220 represents the voltage at anode 124.

The operation of field emission display 100 is characterized by the repetition of a sequence of steps. One of these cycles is referred to as the display frame. In accordance with the invention, each cycle includes a display time, which is represented by timing diagram 200 between times $t_1$ and $t_2$, and a charge reduction time, which is represented by timing diagram 200 between times to and $t_0$ and $t_1$.

During the display time, voltage source 126 supplies a potential, $V_A$, for attracting a plurality of electrons 132 to anode 124. The potential at anode 124 is less than that supplied by voltage source 126 due to the voltage drop over resistor 127. Preferably, the potential, $V_A$, at anode 124 is greater than 600 volts. More preferably, the anode potential, $V_A$, is greater than 1000 volts. Most preferably, the anode potential, $V_A$, is greater than 3000 volts. The potentials applied to a row and a column for causing emission can be, for example, on the order of 80 volts and ground potential, respectively.

During the display time and concurrent with the step of providing a positive potential at anode 124 as described above, rows 115, 116, 117, 118, 119, 120 are sequentially scanned by the row driver (not shown). By scanning it is meant that a potential suitable for causing electron emission is selectively applied to the scanned row. Whether each of electron emitters 114 within a scanned row is caused to emit electrons depends upon the video data and the voltage applied to each column. Electron emitters 114 in the rows not being scanned are not caused to emit electrons. During the display time, a display image is created at anode plate 122, and exposed dielectric surfaces within field emission display 100 can become positively electrostatically charged. For example, in the embodiment of FIG. 1, the dielectric surfaces of spacers 130 become positively electrostatically charged surfaces 129.

Spacers 130 become charged because some of electrons 132 impinge upon spacers 130, rather than reaching anode 124. Because they have a secondary electron yield of greater than one, the surfaces of spacers 130 emit more than one electron for each electron received. Thus, a positive potential is developed at spacers 130.

In accordance with the invention, positively electrostatically charged surface 129 is neutralized during the charge reduction time as depicted in FIG. 2. In the preferred embodiment, the charge reduction time occurs at the end of the display frame. However, other suitable timing schemes can be employed. For example, the charge reduction steps can be performed after multiple row scanning cycles have been executed.

During the charge reduction time and in accordance with the invention, the entirety of electron emitters 114 are caused to emit electrons by applying the appropriate emission/"on" potentials to all of the rows and columns of cathode plate 110. The step of causing all of electron emitters 114 to emit electrons results in the generation of a pull-down current 128 at anode 124, as illustrated in FIG. 1. During the step of causing all of electron emitters 114 to emit, voltage source 126 is not switched.

In general, the value, I, of pull-down current 128 and the resistance, R, of resistor 127 are selected to reduce the positive potential at anode 124 to a value sufficient to cause some of electrons 132 to become attracted by the potential at positively electrostatically charged surface 129. In the preferred embodiment, all of electron emitters 114 are caused to emit during the charge reduction time. Thus, the electron current available both for neutralization and for generating pull-down current 128 is equal to the product of the total number of rows and the maximum emission current per row. Due to the appreciable voltage drop over resistor 127, the voltage at anode 124 drops appreciably. As the voltage drops, electrons 132 become increasingly attracted toward positively electrostatically charged surface 129, causing the fraction of the emission current that reaches anode 124 to fall.

An equilibrium condition is eventually established. At the equilibrium condition, a fraction of the emission current reaches anode 124 and causes a voltage drop over resistor 127. An equilibrium voltage, $V_e$, is realized at anode 124, as indicated in FIG. 2. It is believed that the value of this reduced voltage is slightly above the voltage at the rows. The remaining fraction of the emission current is attracted to and causes neutralization of positively electrostatically charged surfaces, such as positively electrostatically charged surface 129.

The step of adjusting the potential of anode 124 includes the step of reducing the potential of anode 124 to a value sufficient to realize a flux of electrons 132 at positively electrostatically charged surface 129, which is useful for neutralizing the charge. The length of the charge reduction time is selected to allow sufficient time for the desired neutralization of surface 129 and to not distort the display image. After the charge reductive time is completed, the next display frame is commenced with another cycle of row scanning.

The embodiment of FIGS. 1 and 2 provides numerous benefits. For example, switching of the anode potential source is not required, and the power requirements are controlled because the duty cycle is low.

In accordance with the invention, any controllable positive potential within field emission display 100 can be adjusted to a value useful for neutralizing charge at a positively electrostatically charged surface. In the example of FIG. 1, electrons 132 are utilized both to adjust the potential at anode 124 and to neutralize the charge at positively electrostatically charged surfaces. In general, the method of the invention is not limited by the manner in which the controllable positive potential within the display is adjusted. It is further desired to be understood that the potential of the anode can be reduced to a suitable value by causing fewer than all of the electron emitters to emit electrons. For example, only electron emitters proximate to the spacers can be caused to emit.

Figure 3:
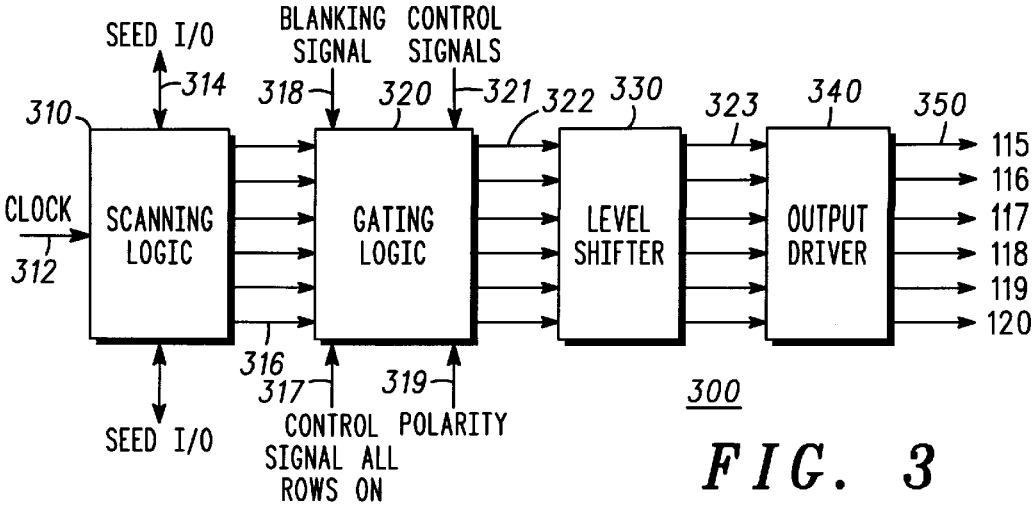
FIG. 3 is a block diagram of a row driver of the preferred embodiment of the invention.

FIG. 3 is a block diagram of a row driver 300 of the preferred embodiment of the invention. As illustrated in FIG. 3, a plurality of output drive signals 350 of row driver 300 are sent one each to rows 115, 116, 117, 118, 119, 120. Output drive signals 350 are useful for controlling electron emission at electron emitters 114. During the display time (FIG. 2), only one of output drive signals 350 has a potential useful for causing emission. During the charge reduction time (FIG. 2), each of output drive signals 350 has a potential useful for causing emission.

Row driver 300 has a scanning logic circuit 310, a gating logic circuit 320, a level shifter circuit 330, and an output driver 340. Scanning logic circuit 310 receives a clock signal 312 and a seed 314. Scanning logic circuit 310 functions as a shift register and shifts incoming video data.

An output 316 of scanning logic circuit 310 is sent to gating logic circuit 320, which controls the asynchronous and simultaneous modes of row activation. A control signal 317 is fed to gating logic circuit 320 and provides for the simultaneous activation of all of the rows. A blanking signal 318 is fed to gating logic circuit 320 and is used to turn off the output of the row driver and overrides all other signals. A polarity signal 319 is fed to gating logic circuit 320 and controls the magnitude of output drive signals 350. A plurality of other signals 321, such as clock signals, seeds, and the like, are fed to gating logic circuit 320 to control its operation.

A plurality of outputs 322 of gating logic circuit 320 are sent to level shifter circuit 330, which generates a plurality of outputs 323. Level shifter circuit 330 converts low-level signals to a useful level. Output driver 340 is an analog device that generates the appropriate values for output drive signals 350.

It will be understood by one of ordinary skill in the art that the sequence of steps in the methods described herein may be altered as appropriate.

The invention is for a method for reducing charge accumulation in a field emission display. The method of the invention includes the steps of causing electron emitters to emit electrons and adjusting the controllable potentials within the display so that the potentials at positively charged surfaces are capable of attracting the emitted electrons to the charged surfaces. In this manner, the positively charged surfaces become neutralized. In the preferred embodiment, the high positive potential at an anode is reduced by causing electron emitters to emit electrons and create a pull-down current at the anode. The anode potential is caused to drop by providing a resistor in series between a D.C. voltage source and the anode. The method of the invention does not require switching of the voltage source that is connected to the anode. This is a benefit because the D.C. voltage source preferably supplies a potential greater than 600 volts, more preferably greater than 1000 volts, and most preferably greater than 3000 volts, and switching at these high voltages can otherwise be difficult.

What is claimed is:

1. A method for reducing charge accumulation in a field emission display comprising the steps of:

providing a first controllable positive potential within the field emission display;

providing a positively electrostatically charged surface within the field emission display;

providing a second controllable positive potential within the field emission display;

adjusting the second controllable positive potential to cause electron emitters within the field emission display to emit electrons; and adjusting the first controllable positive potential to cause electrons to be received by the positively electrostatically charged surface, thereby causing neutralization of the positively electrostatically charged surface.

2. The method for reducing charge accumulation in a field emission display as claimed in claim 1, wherein the step of adjusting the first controllable positive potential is performed concurrently with the step of adjusting the second controllable positive potential to cause electron emitters to emit electrons.

3. The method for reducing charge accumulation in a field emission display as claimed in claim 1, wherein the step of providing a first controllable positive potential comprises the step of providing a first controllable positive potential that is greater than 600 volts.

4. The method for reducing charge accumulation in a field emission display as claimed in claim 3, wherein the step of providing a first controllable positive potential comprises the step of providing a first comtrollable positive potential that is greater than 1000 volts.

5. The method for reducing accumulation in a field emission display as claimed in claim 4, wherein the step of providing a first controllable positive potential comprises the step of providing a first controllable positive potential that is greater than 3000 volts.

6. A method for reducing charge accumulation in a field emission display comprising the steps of:

providing a positive potential at an anode of the field emission display;

providing a positively electrostatically charged surface within the field emission display;

causing electron emitters within the field emission display to emit electrons; and reducing the positive potential at the anode by an amount sufficient to cause electrons to be received by the positively electrostatically charged surface, thereby causing neutralization of the positively electrostatically charged surface.

7. The method for reducing charge accumulation in a field emission display as claimed in claim 6, wherein the step of providing a positive potential at an anode comprises the step of providing a positive potential of greater than 600 volts at the anode.

8. The method for reducing charge accumulation in a field emission display as claimed in claim 7, wherein the step of providing a positive potential at an anode comprises the step of providing a positive potential of greater than 1000 volts at the anode.

9. The method for reducing charge accumulation in a field emission display as claimed in claim 8, wherein the step of providing a positive potential at an anode comprises the step of providing a positive potential of greater than 3000 volts at the anode.

10. The method for reducing charge accumulation in a field emission display as claimed in claim 6, wherein the step of causing electron emitters within the field emission display to emit electrons comprises the step of causing electron emitters within the field emission display to emit electrons to provide a pull-down current at the anode, and wherein the step of reducing the positive potential at the anode comprises the steps of providing a resistor in series with a voltage source connected to the anode and providing a resistance of the resistor and a value of the pull-down current selected to cause the positive potential at the anode to drop to a value sufficient to cause electrons to be received by the positively electrostatically charged surface.

11. The method for reducing charge accumulation in a field emission display as claimed in claim 6, wherein the step of causing electron emitters within the field emission display to emit electrons comprises the step of causing the entirety of electron emitters within the field emission display to emit electrons simultaneously.

12. The method for reducing charge accumulation in a field emission display as claimed in claim 6, wherein the step of providing a positively electrostatically charged surface within the field emission display comprises the step of providing a spacer between a cathode plate and an anode plate of the field emission display.

13. The method for reducing charge accumulation in a field emission display as claimed in claim 6, wherein the step of reducing the positive potential at the anode comprises the step of reducing the positive potential at the anode at the end of each display frame.

14. A method for reducing charge accumulation in a field emission display comprising the steps of:

providing a cathode plate having a plurality of electron emitters that define the entire emissive area of the cathode plate;

providing an anode plate having an anode that opposes the plurality of electron emitters;

providing at the anode a potential;

providing a positively electrostatically charged surface within the field emission display;

causing at least one of the plurality of electron emitters to emit electrons; and adjusting the potential at the anode to cause electrons to be received by the positively electrostatically charged surface, thereby causing neutralization of the positively electrostatically charged surface.

15. The method for reducing charge accumulation in a field emission display as claimed in claim 14, wherein the step of adjusting the potential at the anode is performed concurrently with the step of causing at least one of the plurality of electron emitters to emit electrons.

16. The method for reducing charge accumulation in a field emission display as claimed in claim 14, wherein the step of providing at the anode a potential comprises the step of providing at the anode a potential that is greater than 600 volts.

17. The method for reducing charge accumulation in a field emission display as claimed in claim 16, wherein the step of providing at the anode a potential comprises the step of providing at the anode a potential that is greater than 1000 volts.

18. The method for reducing charge accumulation in a field emission display as claimed in claim 17, wherein the step of providing at the anode a potential comprises the step of providing at the anode a potential that is greater than 3000 volts.

* * * * *